US006260294B1

(12) United States Patent
Pitcher

(10) Patent No.: US 6,260,294 B1
(45) Date of Patent: Jul. 17, 2001

(54) GRAB ATTACHMENT FOR BACKHOE AND EXCAVATOR BUCKETS

(76) Inventor: Warrick Stanley Pitcher, Victoria 3334, Elaine (AU), RMB 1130

( * ) Notice: Subject to any disclaimer, the term of this patent is extended or adjusted under 35 U.S.C. 154(b) by 0 days.

(21) Appl. No.: 09/374,102

(22) Filed: Aug. 16, 1999

(51) Int. Cl.[7] ..... E02F 3/96
(52) U.S. Cl. ..... 37/406; 37/403; 37/903
(58) Field of Search ..... 37/302, 403, 406, 37/903; 414/729, 727

(56) References Cited

U.S. PATENT DOCUMENTS

| | | | | |
|---|---|---|---|---|
| D. 332,271 | * | 1/1993 | DuBose et al. | D15/32 |
| 2,870,925 | * | 1/1959 | Bernad et al. | 37/406 |
| 3,275,172 | * | 9/1966 | Smith | 37/409 |
| 3,802,731 | * | 4/1974 | La Bounty | 294/88 |
| 3,972,147 | | 8/1976 | Bigham . | |
| 4,375,345 | * | 3/1983 | Hanson | 414/722 |
| 4,403,906 | * | 9/1983 | Holopainen | 414/724 |
| 4,407,626 | * | 10/1983 | Bruckner | 414/740 |
| 4,770,597 | * | 9/1988 | Powers | 414/740 |
| 4,858,346 | * | 8/1989 | Schulte | 37/184 |
| 5,123,185 | * | 6/1992 | Pollard | 37/117.5 |
| 5,544,435 | * | 8/1996 | Somero | 37/405 |
| 5,553,408 | * | 9/1996 | Townsend | 37/406 |
| 5,678,332 | * | 10/1997 | Hawkins | 37/403 |
| 5,921,302 | * | 7/1999 | Petersen | 144/334 |
| 5,927,933 | * | 7/1999 | Tucker | 414/729 |
| 5,957,650 | * | 9/1999 | Rollo | 414/724 |
| 6,120,237 | * | 9/2000 | Cummings et al. | 414/729 |

FOREIGN PATENT DOCUMENTS

61889/94 10/1994 (AU) .

WO 95/02095 1/1995 (WO) .

OTHER PUBLICATIONS

Australian Patent Abridgment AU–B–62438/80 , Roy E. Labounty, Grapple Assembly for Backhoe Boom, Mar. 26, 1981 (2 pages).

Abstract JP 8226138–A, Jonathon Mills, [Sanyo Kiki KK], Hydraulic Switching Appts for Industrial Machine . . . , Sep. 3, 1996 (1 page).

Abstract JP 08311915–A, Jonathon Mills, [Kawasaki Heavy Ind.], Frame of Clamping Construction Machine . . . , Nov. 26, 1996 (1 page).

Abstract SU 727–769, Jonathon Mills, [KOVROV Excavator Wk (MOSG=)], Single Bucket Excavator Digging Equipment . . . , Apr. 25, 1980 (1 page).

Abstract DE 4108315, Jonathon Mills, [Maier, J.], Earth Moving Bucket Machine . . . , Sep. 24, 1992, (1 page).

* cited by examiner

*Primary Examiner*—H. Shackelford
*Assistant Examiner*—Kristine Markovich
(74) *Attorney, Agent, or Firm*—Shlesinger, Arkwright & Garvey LLP

(57) ABSTRACT

An attachment 10 for a backhoe or excavator having a moveable boom 1 to which a bucket 2 is pivoted including mounting brackets 11, 12 with which a closure member 10 is pivoted to the bucket 2, the closure member 10 including a straight portion 15 and an angular portion 17 extending therefrom at an angle of about 120°, a rigid link pivoted to a bracket on the boom 1 of the backhoe and extending to the closure member to cause pivotal movement of the closure member with respect to the bucket 2 as the bucket 2 is pivoted with respect to the boom 1, the closure 10 and the bucket performing a grapple function while enabling the bucket to perform its usual digging function when the closure member is in its fully open position.

12 Claims, 5 Drawing Sheets

GRAB ATTACHMENT FOR BACKHOE AND EXCAVATOR BUCKETS

FIELD OF THE INVENTION

This invention relates to grab members for attachment to the buckets of backhoes, excavators and the like.

BACKGROUND OF THE INVENTION

Backhoes and excavators are widely used in the construction industry but are only able to be used to perform digging and earth moving functions with limited ability to securely transfer other objects, such as rocks, debris, drainage pipes and the like.

Purpose-built bucket structures have been proposed for increasing the versatility of buckets used in the construction industry by incorporating an additional jaw which is hydraulically manipulated to open and close the bucket structure. Examples of such proposals will be found in AU-A-61889/94, W095/02095 and U.S. Pat. No. 3,972,147. These proposals are complex and therefore expensive and they limit the use of the bucket in its normal manner.

Purpose-built grapples have also been proposed for lifting objects such as logs, pipes, rocks and the like, and an example of such a proposal is found in AU-A-62438/80. While such grapples are able to function in transferring the above types of objects, they can only be used for these purposes and cannot be used to perform normal backhoe and excavator functions.

Since backhoes and excavators are widely used, it would be an advantage to provide a means by which the buckets of such equipment may be converted to provide a grab or "grapple" function which does not inhibit the usual backhoe and excavator bucket functions.

SUMMARY OF INVENTION AND OBJECT

It is an object of the present invention to provide an attachment for converting the bucket of a backhoe or excavator so as to be able to provide a grab or "grapple" function.

The invention provides an attachment for a backhoe or excavator having a movable boom to which a bucket having sides defining an open mouth is pivoted, including mounting means attached to the boom and to the open mouth of the bucket, a grab member pivoted to the bucket mounting means, and linkage means pivotally attached to the boom mounting means and to the grab member to enable the grab member to be manipulated by movement of the bucket between an open position in which the bucket is able to function in a normal manner and a closed position in which an object is able to be clamped between the grab member and the mouth of the bucket or the mouth of the bucket is at least partly covered, said grab member having a substantially straight portion extending from the pivot and an angular portion extending from the straight portion, the length of the grab member and the angle between its portions being selected to facilitate said manipulation of the grab member between its open position and its closed position.

In a preferred form, the length of the grab member is about 75%±15%, and preferably ±about 7%–8%, of the length of the bucket from its tip to its pivot point with respect to the boom. The angle between the straight portion and the angular portion of the grab member being about 120°±about 20°, and preferably ±about 15°. The length of the straight portion is about 75%±about 15% of the length of the grab member, and preferably ±about 7%–8%, while the angular portion is about 60%±about 15°, and preferably ±about 7%–8% of the length of the straight portion. The point of pivotal attachment of the link to the grab member is about 45% of the length of the grab member±about 10%, and preferably ±about 4%–5% from the pivot.

The grab member may include two or more tine members connected by cross members to render the grab member substantially rigid. In a preferred form, three spaced tines connected by cross members define the grab member.

The invention also provides an attachment for a front loader having a moveable boom to which a bucket having sides defining an open mouth is pivoted, including mounting means attached to the boom and to one side of the bucket, a grab member pivoted to the bucket mounting means, and linkage means pivotally attached to the boom mounting means and to the grab member to enable the grab member to be manipulated by movement of the bucket between an open position in which the bucket is able to function in the normal manner and a closed position in which the mouth of the bucket is at least partly covered by the grab member, said grab member having a substantially straight portion extending from the pivot and an angular portion extending from the straight portion, the length of the straight and angular portions of the grab member and the angle between its portions being selected to facilitate said manipulation of the grab member between its open position and its closed position.

BRIEF DESCRIPTION OF THE DRAWINGS

In order that the invention may be more readily understood, one preferred embodiment of the invention will now be described with reference to the accompanying drawings in which.

DESCRIPTION OF PREFERRED EMBODIMENT

Figure 1:
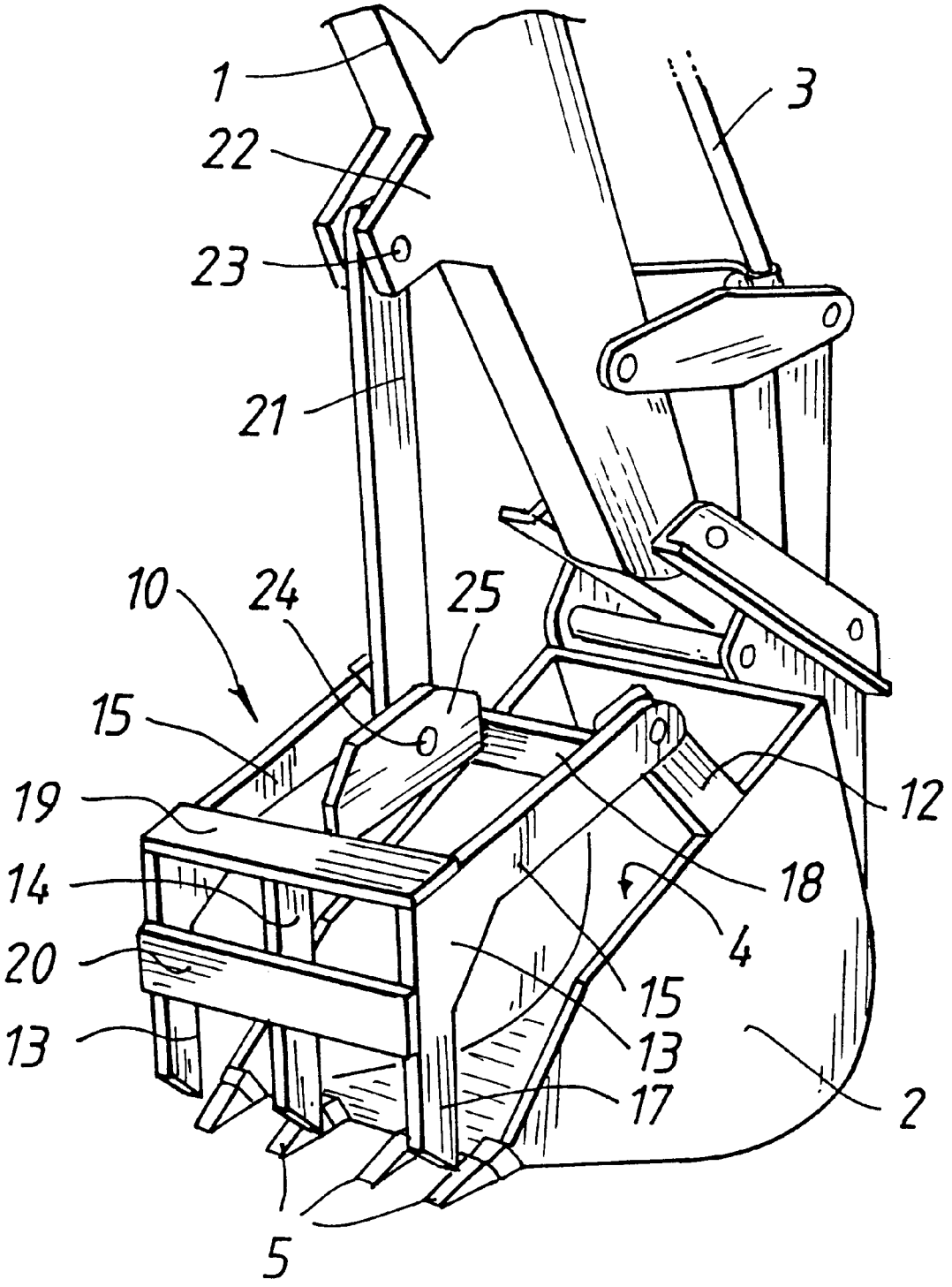
FIG. 1 is a perspective view of a backhoe bucket to which the attachment embodying the invention is shown in the closed position.
Figure 2:
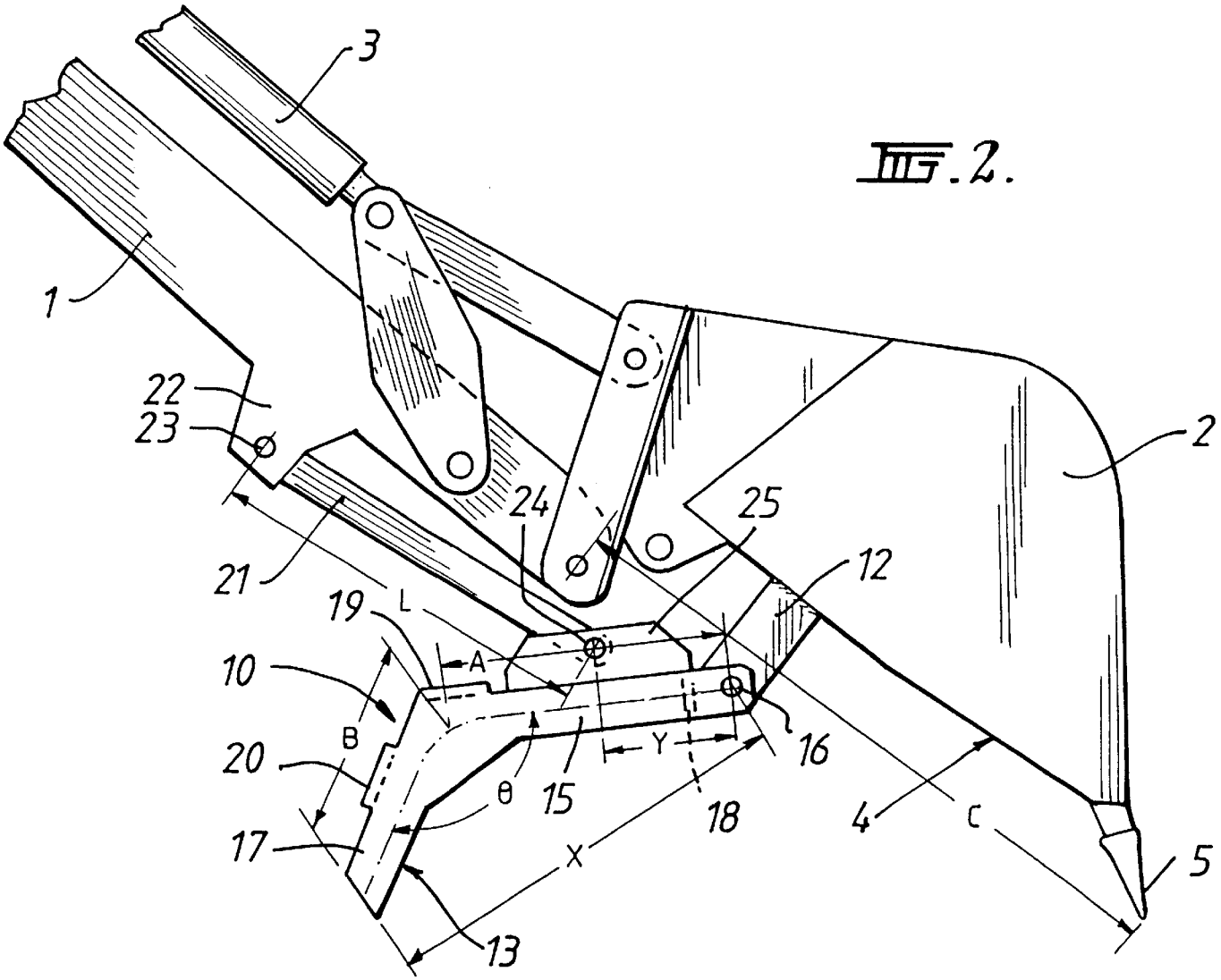
FIG. 2 is a side elevation of the backhoe boom and bucket showing the closure member in the open position.

Referring to FIGS. 1 and 2, the backhoe shown is of known construction having a boom 1 and a bucket 2 pivoted to the free end of the boom 1 and capable of pivotal movement with respect to the boom 1 by hydraulic ram means 3 operating through the linkages shown. The bucket 2 has a open mouth 4 ending in digging teeth defining a free edge 5.

The grab member 10 embodying the invention is pivotally attached to the open mouth 4 of the bucket 2 by a pair of brackets 11 and 12 located adjacent the rear end of the bucket mouth 4. The grab member 10 includes side tine members 13 and a central tine member 14, each member 13 has a relatively straight portion 15 attached to the brackets 11, 12 by pivot pin 16, and an angular end portion 17 extending from the straight portion 15 at an angle Ø. The side tine members 13 and the central tine member 14 are connected by cross members 18, 19 and 20 rigidly secured thereto to form a rigid closure structure.

A rigid link 21 is pivotally connected at one end to the boom 1 by means of brackets 22 on the boom engaged by a pivot pin 23. At the other end, the link 21 is pivotally connected to the central tine member 14 by a pivot pin 24 engaging a bracket 25 attached to the central tine member 14.

As illustrated in FIG. 2, the open mouth 4 of the bucket 2 has a length C from the pivot to the free edge 5, while the grab member 10 has a length X from its pivot 16 to the tips of the tine members 13 and 14. The straight portion of each tine member 13, 14 has a length A and the angular end portions 17 have a length B. The rigid link 21 has a length L while the position of the pivot pin 24 is a distance Y from the pivot 16. To provide the required functional relationship between the grab member 10 and the bucket 2, the length X should be about 75% of C±about 15%, and preferably ±about 7%–8%. The distance Y is about 45% of X±about 10%, and preferably ±about 4%–5%. The dimension A is about 75% of X±about 15%, and preferably ±about 7%–8%, while the dimension B is about 60% of A±about 10%, and preferably ±about 4%–5%.

The positioning of the brackets 11 and 12 and 22 is not critical, but they should of course be positioned selectively by the engineer converting the backhoe so that the grab member is able to function in the desired manner. As shown in the drawings, the brackets 11 and 12 are positioned adjacent the rear edge of the bucket 2, but not so close as to cause the link 21 to contact the boom 1 until the grab member 10 is in its fully open position, as illustrated in FIG. 2. The bracket 22 is approximately in alignment with attachment point of the ram to the boom 1. Such an arrangement of the brackets enables the grab member 10 to be manipulated in the manner illustrated in FIGS. 1 to 4 by pivoting the bucket 2 using the ram 3.

Figure 3:
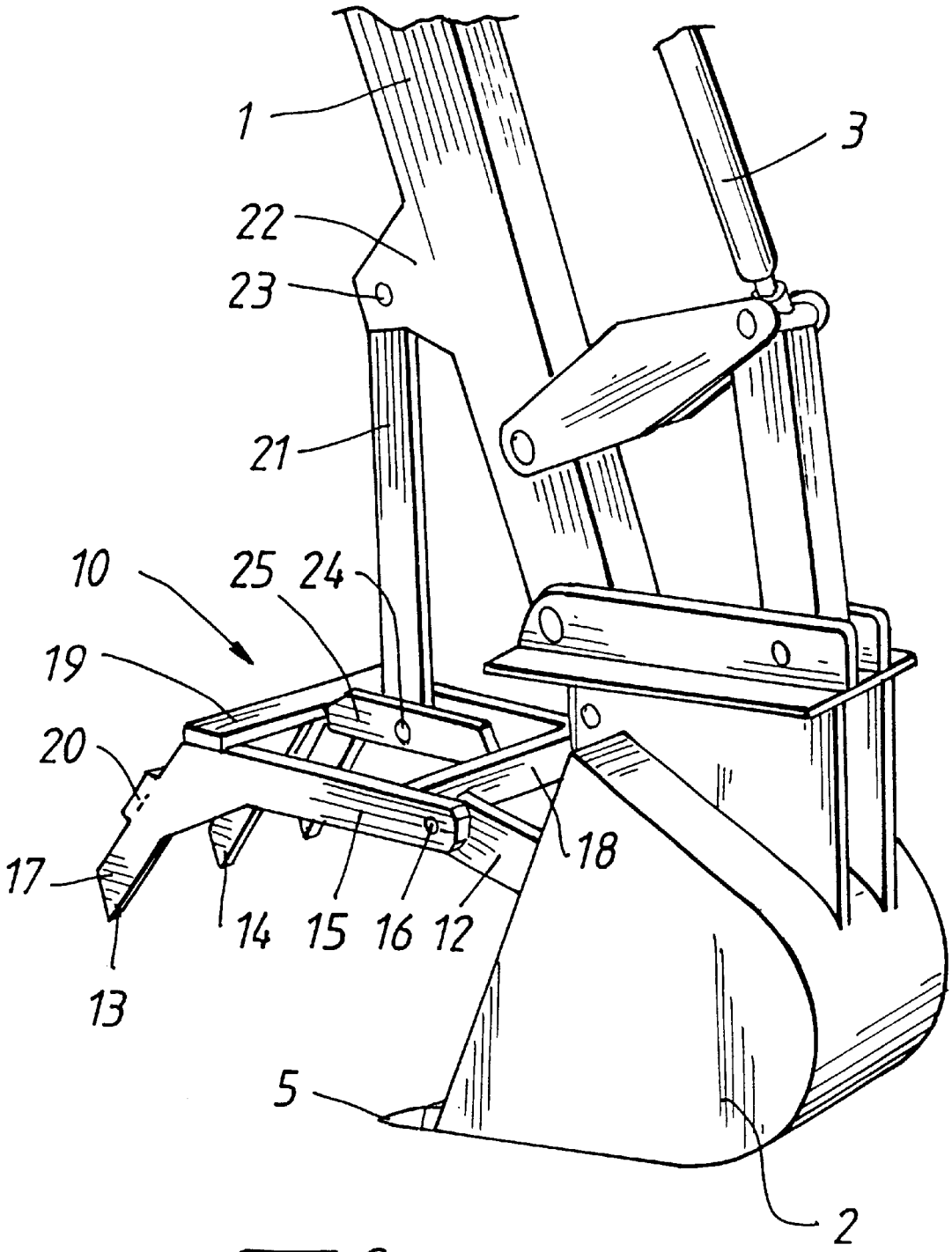
FIG. 3 is a perspective side view showing the backhoe performing a digging function.
Figure 4:
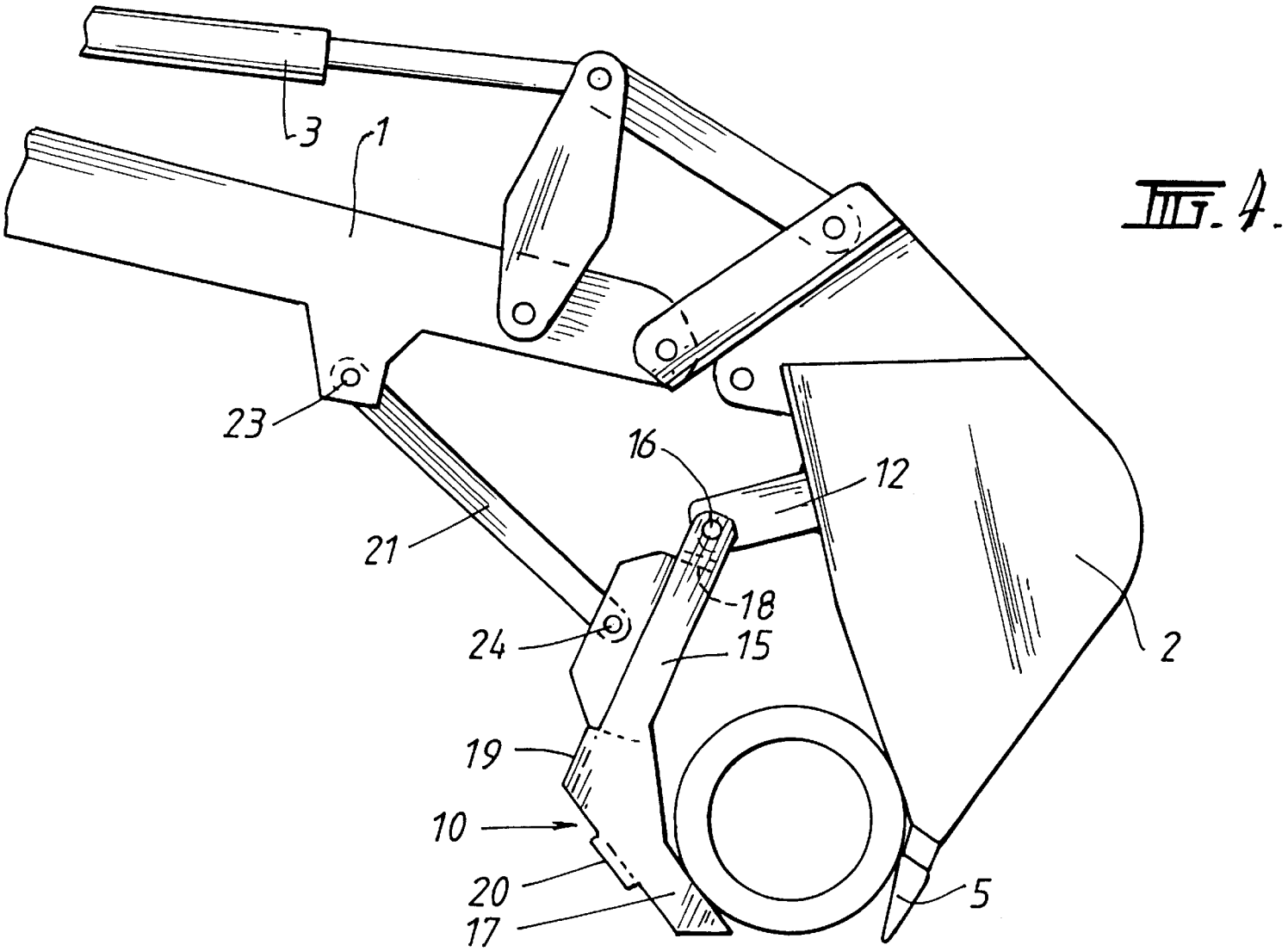
FIG. 4 is a side elevation showing the closure member being used to lift a drainage pipe.

In FIG. 1, the grab member 10 is shown in an essentially closed position over the open mouth 4 of the bucket 2 to assist in retaining materials in the bucket 2. However, when the closure 10 is in its open position, illustrated in FIGS. 2 and 3, the bucket 2 is still able to be operated in the usual digging mode, as illustrated in FIG. 3, and as the bucket 2 pivots during digging, the grab member 10 moves towards its closed position to assist in retaining the contents of the bucket 2. When it is necessary to lift awkward objects, such as large drainage pipes, rocks, logs and elongate debris, the bucket 2 is located on one side of the object and the bucket pivoted until the grab member 10 clamps the object in the manner illustrated in FIG. 4.

In the embodiment illustrated, the bucket of a standard backhoe or excavator is converted by the fitting of the closure 10 to become a multi-purpose construction machine able to perform grabbing functions as well as the usual digging function. Conversion is achieved at a fraction of the cost of a purpose-built grapple, and the bucket is still able to function in all the usual digging and scraping modes without removing the closure. A purpose-built grapple is of course unable to perform these functions.

Figure 5:
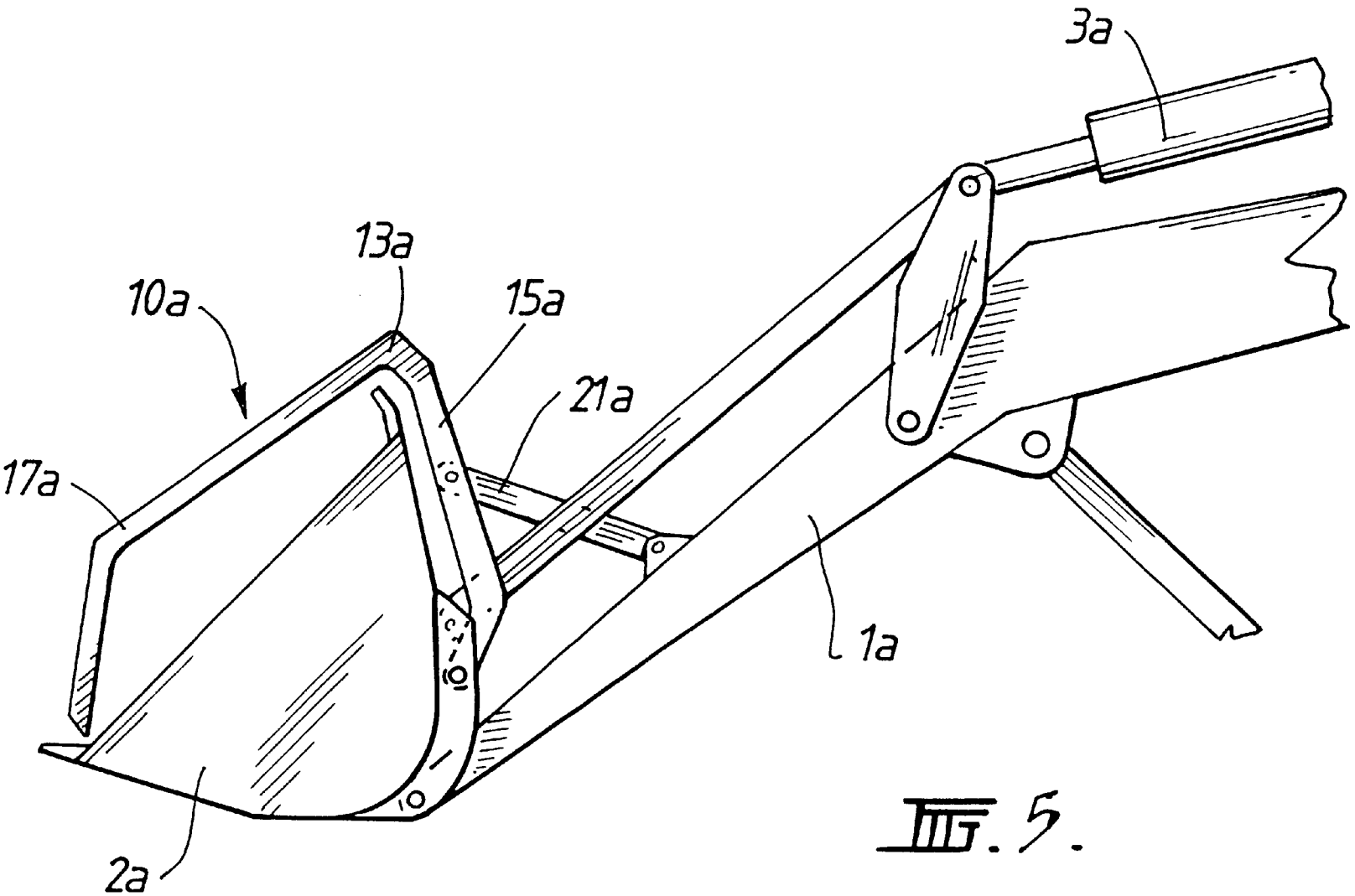
FIG. 5 is a schematic side elevation of a second embodiment showing a grab member attached to the bucket of a front end loader.

In the alternative embodiment of FIG. 5, a grab member 10*a* is pivoted to the bucket 2*a* at the end of the boom 1*a* of the front-end loader, the bucket being operated in the usual way by a ram 3*a* through the linkages shown. The grab member 10*a* is formed from a multiplicity of tine or lite members 13*a* joined by cross frame members (not shown). The members 13*a* are pivoted to the bottom of the bucket 2*a* and have substantially straight portions 15*a* which extend up the back of the bucket and an angular portion 17*a* which extends over the top of the bucket 2*a* in the manner shown in FIG. 5. A rigid link 21*a* extends between the boom 1*a* and a central one of the members 13*a* where it is pivoted to allow manipulation of the grab member 10*a* in a manner similar to the previous embodiment by pivotal movement of the bucket 2*a* with respect to the boom 1*a*. It will be appreciated that the grab member 10*a* provides closure and grabbing functions similar to the first embodiment, and facilitates a useful conversion of the front-end loader.

In each of the above embodiments, the members 13, 14 and 13*a* can have a covering material attached thereto to provide a better closure function for particulate or loose material.

I claim:

1. An attachment for a backhoe or excavator having a movable boom to which a bucket having back, bottom and side walls defining an open mouth is pivoted, the bucket having a pivot point adapted to be connected to the boom, said pivot point being disposed near the back wall, comprising:

a) a grab member having one end pivotally connected to the bucket side walls at a point a distance from the bucket pivot point; and b) a linkage pivotally attached to the boom and to a portion of said grab member between said pivot point of the grab member and the free end of said grab member such that said grab member is manipulated by movement of the bucket between an open position in which the bucket is able to function in a normal manner and a closed position in which an object is able to be clamped between the grab member and the mouth of the bucket or the mouth of the bucket is at least partly covered.

2. An attachment as in claim 1, and further comprising:

a) brackets attached to the side walls of the bucket; and b) said one end of said grab member is pivotally attached to said brackets.

3. An attachment as in claim 2, wherein said brackets are located adjacent the rear end of the bucket mouth.

4. An attachment as in claim 1, wherein said grab member includes a substantially straight portion extending from said one end and an angular portion extending from said straight portion.

5. An attachment as in claim 4, wherein:

a) the length between the bucket pivot point and the bucket free edge is C, and the length of said grab member from said one end to its free end is X; and b) X is about 75%±about 15% of C.

6. An attachment as in claim 4 wherein:

a) the length between the bucket pivot point and the bucket free edge is C, and the length of said grab member from said one end to its free end is X; and b) X is about 75%±about 7–8% of C.

7. An attachment as in claim 4, wherein the angle between said substantially straight portion and said angular portion is about 120°±about 20°.

8. An attachment as in claim 4, wherein the angle between said substantially straight portion and said angular portion is about 120°±about 15°.

9. An attachment as in claim 4, wherein:

a) the length of said substantially straight portion is about 75%±about 15% of the length of said grab member; and b) the length of said angular portion is about 60%±about 15% of the length of said substantially straight portion.

10. An attachment as in claim 4, wherein:

a) the length of said substantially straight portion is about 75%±about 7–8% of the length of said grab member; and b) the length of said angular portion is about 60%±about 7–8% of the length of said substantially straight portion.

11. An attachment as in claim 1, wherein the length from the pivotal attachment of said link to said grab member to the pivotal attachment of said grab member to the bucket is about 45% about±10% of the length of said grab member.

12. An attachment as in claim 1, wherein the length from the pivotal attachment of said link to said grab member to the pivotal attachment of said grab member to the bucket is about 45%±about 4–5% of the length of said grab member.

* * * * *